United States Patent [19]

Breneman

[11] 4,294,032

[45] Oct. 13, 1981

[54] TOY SIMULATED ROCKET PROPELLED AIRCRAFT SYSTEM

[75] Inventor: Jack L. Breneman, Orchard Park, N.Y.

[73] Assignee: The Quaker Oats Company, Chicago, Ill.

[21] Appl. No.: 114,279

[22] Filed: Jan. 22, 1980

[51] Int. Cl.[3] ..... A63H 33/00

[52] U.S. Cl. ..... 46/1 R; 46/74 R

[58] Field of Search ..... 46/1 H, 17, 1 R, 74 H, 46/74 C, 74 R, 76 R, 79, 76 A, 116, 202, 206, 175 R, 232, 228, 249, 91; 244/2, 161, 162, 158

[56] References Cited

U.S. PATENT DOCUMENTS

| | | | |
|---|---|---|---|
| 3,126,667 | 3/1964 | Rabinow | 46/17 |
| 3,289,974 | 12/1966 | Cohen et al. | 244/2 X |
| 3,418,751 | 12/1968 | Mabuchi | 46/93 X |

OTHER PUBLICATIONS

"Space Shuttle", *NASA Facts,* U.S. Gov. Printing Office, No. 003-000-00679-9, 1977.

"Willy Ley Space Models", *American Modeler,* vol. 52, No. 1, Apr. 1959, p. 11.

*Primary Examiner*—Gene Mancene

*Assistant Examiner*—Mickey Yu

*Attorney, Agent, or Firm*—Cumpston & Shaw

[57] ABSTRACT

A mother aircraft has a fuselage, and a releasable rocket mounted thereon for propelling it. The fuselage has an opening therein, and a cover for the opening movable between open and closed positions. A miniature rocket propelled aircraft is selectively mountable within the fuselage and on the cover when it is in its closed position. The rocket is selectively releasably mounted on the mother and miniature aircraft.

10 Claims, 5 Drawing Figures

TOY SIMULATED ROCKET PROPELLED AIRCRAFT SYSTEM

BACKGROUND OF THE INVENTION

1. Field of the Invention

The present invention relates generally to toys, and more particularly to a toy simulated rocket propelled aircraft system.

2. Description of the Prior Art

Toy simulated rocket propelled aircraft per se are known in the art. It is also known to incorporate sound producing means within the aircraft to produce a simulated rocket sound of increasing intensity occurring at the blast-off.

SUMMARY OF THE INVENTION

In accordance with a preferred embodiment of the invention, a toy simulated rocket propelled aircraft system is provided wherein a mother aircraft has a releasable rocket mounted thereon. The mother aircraft has a fuselage, an opening leading therein, and a cover for the opening movable between open and closed positions. A miniature rocket propelled aircraft is selectively mountable within the fuselage when the cover is open or closed and on top of the cover when it is closed. The rocket is selectively releasably mounted on the mother and miniature aircraft.

In another aspect of the invention, a first mounting means is provided in the fuselage for releasably holding the miniature aircraft, and a second mounting means is provided on the cover for releasably holding the miniature aircraft.

In a more specific aspect of the invention, the first mounting means comprises vertically oriented, spaced apart slots for receiving laterally extending lugs on the miniature aircraft. The aircraft is movable to a pivoted position for simulated launch, and a latch releasably holds the aircraft in the pivoted position.

In another aspect of the invention, the second mounting means comprises a pair of parallel rails on the cover in its closed position, and a T-shaped groove on the miniature aircraft for receiving the rails when the aircraft is mounted thereon.

In still another aspect of the invention, the rocket is selectively releasably mounted on the mother and miniature aircraft. Also, a pilot in each aircraft is capable of being mounted on one end of a simulated life support line, the other end of which is mounted on the mother aircraft.

The aforementioned aspects of the invention provide the advantage of a very versatile aircraft system capable of providing many different combinations of coacting aircrafts and parts and sounds, all of which are fascinating, intriguing and pleasing to children.

The invention and its advantages will become more apparent from the detailed description of the invention presented below.

BRIEF DESCRIPTION OF THE DRAWING

The details of this invention will be described in connection with the accompanying drawing, in which.

DETAILED DESCRIPTION OF THE INVENTION

Figure 1:
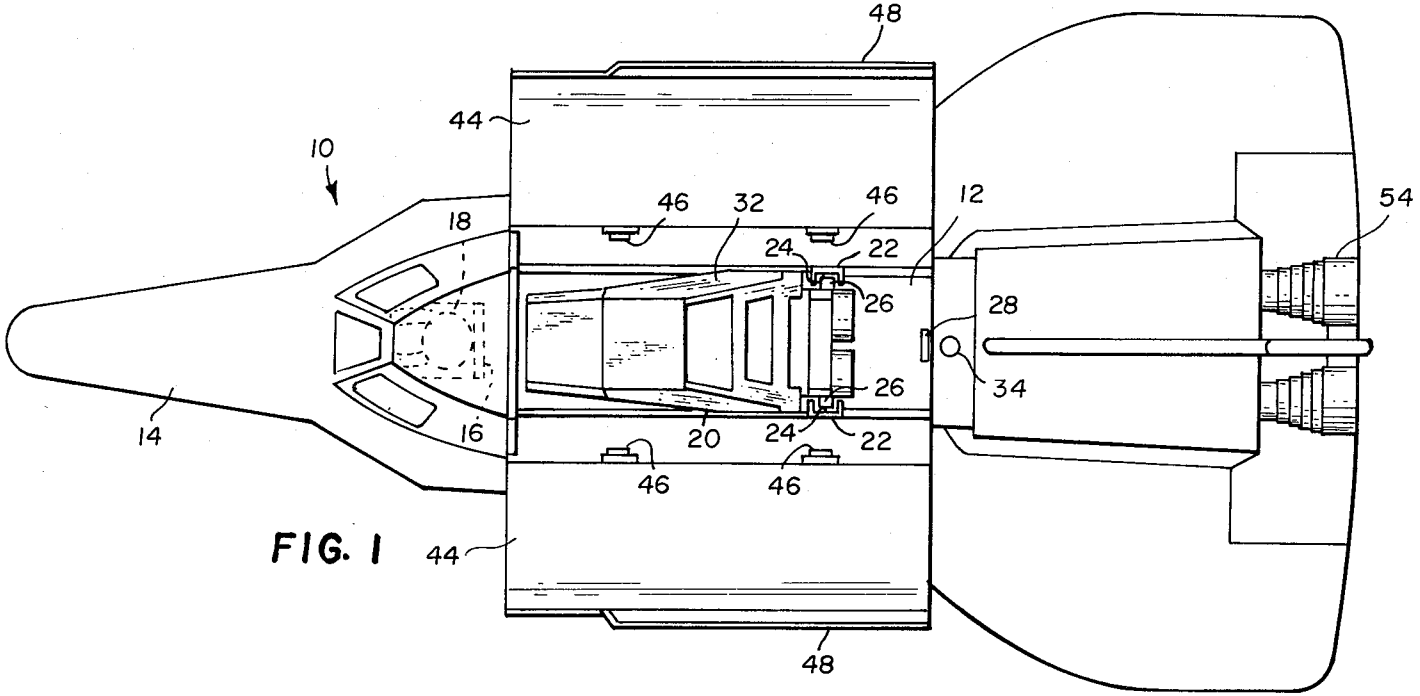
FIG. 1 is a top plan view of the mother aircraft of this invention with the fuselage cover in its open position showing the miniature aircraft and other features.

Referring now to FIG. 1 of the drawing, a mother aircraft 10 is disclosed having a fuselage 12 and a cockpit 14 within which is slidably mounted a seat having a back support 16 for releasably supporting a pilot 18 in a sitting position. The seat is manually movable from its flying position, shown in dotted lines, to a retracted position, not shown, for removal of the pilot. Any suitable detent means, not shown, retains seat 16 in its flying and retracted positions.

Figure 2:
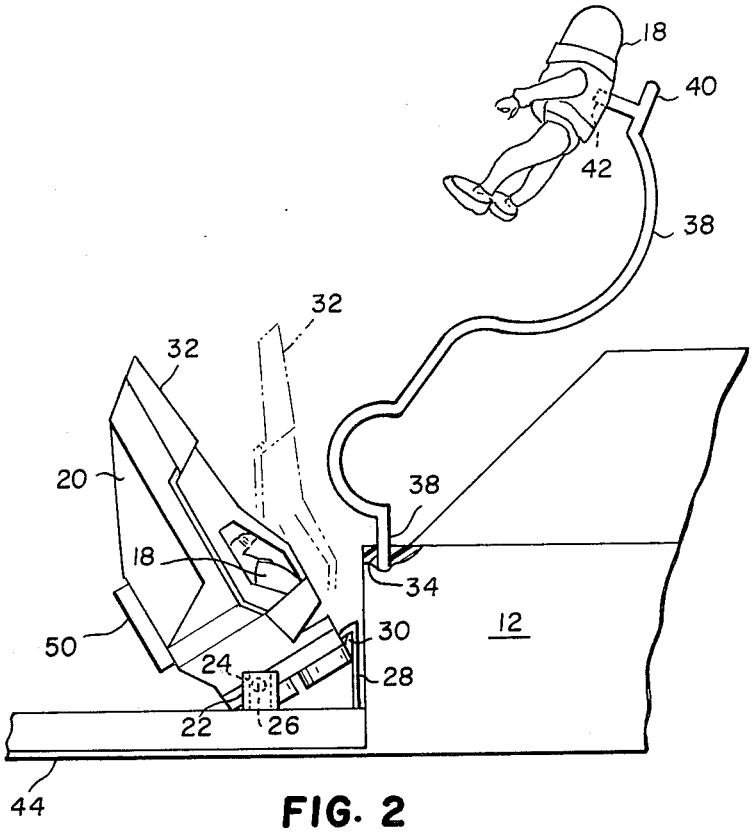
FIG. 2 is a segmental side elevational view of the mother aircraft of FIG. 1 showing the miniature aircraft in a latched pivoted position simulating a launch position.

With reference to FIGS. 1 and 2, mother aircraft 10 further has a miniature aircraft 20 mounted within fuselage 12. The fuselage has a pair of vertical spaced apart brackets 22 containing elongated vertical slots 24 for receiving laterally extending circular lugs 26 on miniature aircraft 20 when it is mounted within fuselage 12. Aircraft 20 is further pivotal about lugs 26 to a pivotal position simulating a launch or blast-off position. A latch comprising a flexible hook member 28 engages a shoulder 30 on aircraft 20 for releasably holding it in the launch position. Aircraft 20 further has a pivotal canopy 32 for opening the aircraft to remove the pilot 18 contained therein.

Further, with reference to FIG. 2, aircraft fuselage 12 is provided with an opening 34 for releasably receiving one end 36 of a support life line 38. The opposite end 40 of the support line can be releasably pressed into a receiving opening 42 in the back of each pilot 18.

Figure 3:
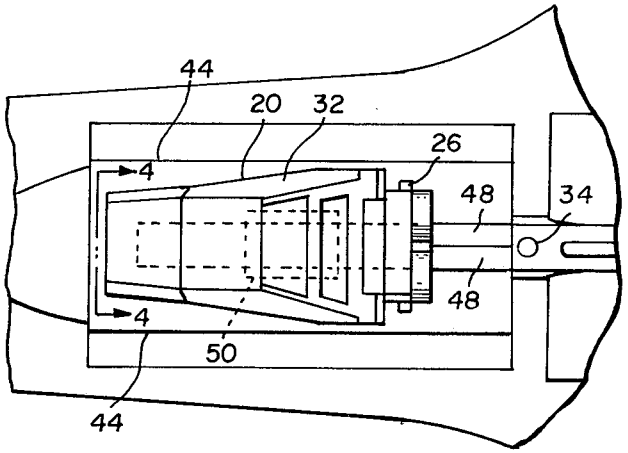
FIG. 3 is a segmental side elevational view of the mother aircraft of FIG. 1 showing the cover closed and the miniature aircraft mounted thereon.
Figure 4:
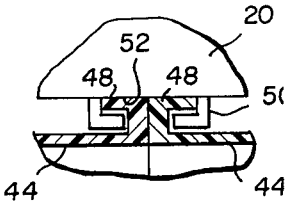
FIG. 4 is a segmental front elevational view of the miniature aircraft of FIG. 3 showing how it is mounted on the cover.

With reference to FIGS. 1, 3 and 4, the opening leading into fuselage 12 is provided with a cover shown as a pair of hinged doors 44. The doors are preferably hinged to the fuselage of aircraft 10 by overcenter springs 46 or the like for releasably holding the doors in open and closed positions. Doors 44 each have a rail 48 along the top edge which cooperate in the closed position (FIG. 4) to form an aircraft support bracket of T-shaped cross-section. Aircraft 20 has a depending plate 50 provided with a T-shaped groove 52 for slidably receiving the support brackets when aircraft 20 is slidably mounted on the bracket.

Figure 5:
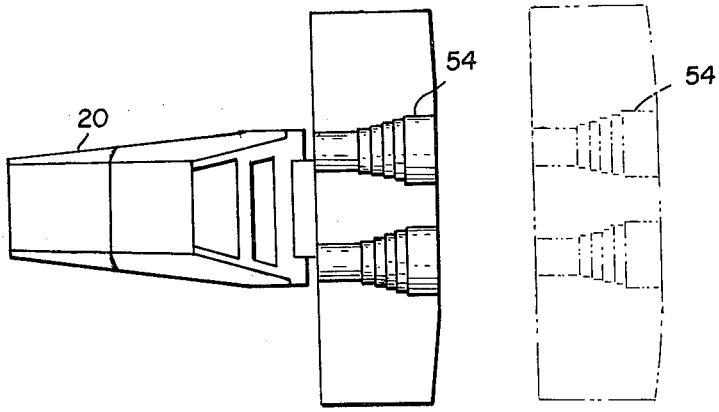
FIG. 5 is a side elevational view of the miniature aircraft with the mother aircraft rocket mounted thereon.

With reference to FIG. 5, another possible source of playful entertainment involves removing a releasable rocket 54 from mother aircraft (FIG. 1), and slidably mounting it on the rocket on miniature aircraft 20 to achieve additional rocket thrust.

The mother aircraft is further provided with electronic sound producing equipment of known type, not shown, for simulating various sounds. An example of the sounds simulated are rocket blast-off sounds of increasing intensity, telemetric sounds and intermittent beeping warning sounds concomitant with flashing lights on the aircraft. The sound equipment and lights are actuated by three buttons, not shown, mounted on the fuselage.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy simulated rocket propelled aircraft system comprising in combination:

a mother aircraft having a fuselage and an opening leading therein;

a rocket mounted on the rear end of said mother aircraft for propelling it;

cover means for said fuselage opening movable between open and closed positions;

first mounting means in said fuselage;

second mounting means on said cover means when said cover means are in said closed position; and a miniature rocket propelled aircraft selectively releasably mountable on said first and second mounting means.

2. A toy simulated rocket propelled aircraft system according to claim 1 wherein said rocket is selectively releasably mounted on said mother aircraft and said miniature aircraft.

3. A toy simulated rocket propelled aircraft system according to claim 1, and further comprising a pilot mounted in each of said mother and miniature aircraft, and a simulated life support line having one end secured to said mother aircraft and its opposite end secured to a pilot.

4. A toy simulated rocket propelled aircraft system comprising in combination:

a mother aircraft having a fuselage and an opening leading therein;

a rocket mounted on said mother aircraft for propelling it;

cover means for said fuselage opening movable between open and closed positions;

a miniature rocket propelled aircraft selectively mountable within said fuselage and on said cover means when it is in its closed position, said miniature aircraft having laterally extending lugs;

first mounting means in said fuselage comprising vertically spaced apart brackets having vertical slots for receiving said laterally extending lugs on said miniature aircraft when selectively mounted within said fuselage; and said mounting means on said cover means when in said closed position for releasably holding said miniature aircraft when selectively mounted on said cover means.

5. A toy simulated rocket propelled aircraft system according to claim 1 wherein said miniature aircraft is pivotally movable about said lugs to a pivoted position, and said first mounting means further comprises a latch for releasably latching said miniature aircraft in said pivoted position.

6. A toy simulated rocket propelled aircraft system according to claim 4 wherein said second mounting means comprises a pair of parallel rails on said cover means which in its closed position forms a T-shaped bracket, and a T-shaped groove on said miniature aircraft for slidably receiving said bracket when said miniature aircraft is mounted thereon.

7. A toy simulated aircraft system comprising in combination:

a mother aircraft having a fuselage and an opening leading therein;

cover means for said fuselage opening movable between open and closed positions;

a miniature aircraft selectively mountable within said fuselage and on said cover means when it is in its closed position, said miniature aircraft having laterally extending lugs;

first mounting means in said fuselage comprising vertically spaced apart brackets having vertical slots for receiving said laterally extending lugs on said miniature aircraft when selectively mounted within said fuselage; and second mounting means on said cover means when said cover means is in said closed position for releasably holding said miniature aircraft when selectively mounted on said cover means.

8. A toy simulated aircraft system according to claim 7 wherein said miniature aircraft is pivotally movable about said lugs to a pivoted position, and said first mounting means further comprises a latch for releasably latching said miniature aircraft in said pivoted position.

9. A toy simulated aircraft system according to claim 7 or 8 wherein said second mounting means comprises a pair of parallel rails on said cover means which in its closed position forms a T-shaped bracket, and a T-shaped groove on said miniature aircraft for slidably receiving said bracket when said miniature aircraft is mounted thereon.

10. A toy simulated aircraft system comprising in combination:

a mother aircraft having a fuselage and an opening leading therein;

cover means for said fuselage opening movable between open and closed positions;

first mounting means in said fuselage;

second mounting means on said cover means when said cover means are in said closed position; and a miniature aircraft selectively releasably mountable on said first and second mounting means.

* * * * *